United States Patent [19]

Tindale

[11] Patent Number: 4,809,984

[45] Date of Patent: Mar. 7, 1989

[54] PUTTING STROKE CORRECTION DEVICE

[76] Inventor: John C. Tindale, 374 Bonnie Brae Ave., Rochester, N.Y. 14618

[21] Appl. No.: 203,297

[22] Filed: Jun. 2, 1988

[51] Int. Cl.[4] ..... A63B 69/36

[52] U.S. Cl. ..... 273/183 E; 273/186 R; 273/192; 273/164

[58] Field of Search ..... 273/186 R, 186 A, 186 B, 273/186 C, 186 D, 191 R, 191 A, 191 B, 192, 184 R, 185 R, 183 A, 183 E, 164, 163 R, 163 A, 183 D; 33/262, 508

[56] References Cited

U.S. PATENT DOCUMENTS

| | | | |
|---|---|---|---|
| 3,232,623 | 2/1966 | Abrams et al. | 273/186 R |
| 3,680,860 | 8/1972 | Elkins | 273/164 |
| 3,826,495 | 7/1974 | Elkins | 273/164 |
| 4,167,268 | 9/1979 | Lorang | 273/183 E |

*Primary Examiner*—George J. Marlo

*Attorney, Agent, or Firm*—Shlesinger, Fitzsimmons & Shlesinger

[57] ABSTRACT

The device is mounted on a horizontal surface in spaced relation to a putting hole or replica thereof. The head of a putter is releasably clamped on the face of a flat plate, which is mounted for limited rotation on the base of the device, and with the face of the putter in coplanar engagement with a pair of spaced, coplanar reference surfaces that lie in a generally vertical plane. At the outset the plate is locked in a starting position in which the putter face is accurately aligned with the hole—i.e., in a plane normal to a line connecting the center of the hole with the pivotal axis of the plate. The plate is then momentarily unlocked and the golfer rotates the handle of the putter as appears necessary to align its face with the hole. The plate is then locked in the adjusted position and graduations on the plate are read against a reference mark on the base to determine the misalignment introduced by the golfer.

8 Claims, 1 Drawing Sheet

PUTTING STROKE CORRECTION DEVICE

BACKGROUND OF THE INVENTION

This invention relates to the game of golf, and more particularly to a novel device for correcting the putting stroke of a golfer by compensating for any inherent aberation in his or her putting stroke.

Putting is the scourge of many a golfer, be the golfer male or female. In search of a solution to improve one's putting game, a variety of theories and/or devices have been developed, and frequently have led to patentable discoveries. Among such discoveries is a putter sighting device disclosed in U.S. Pat. No. 3,951,415. The device is removably and adjustably clamped to the shaft of a putter to assist the player in correctly swinging the club. U.S. Pat. No. 4,174,839 discloses a putter having on the upper surface of its head a plurality of angularly spaced lines which theoretically should help a golfer master sloping greens. U.S. Pat. No. 4,462,595 discloses a putter having a retractable pin or spike, which is insertable into the ground to retain the club upright adjacent the ball while the golfer remains free to move to a vantage point remote from the club and ball to help read a green.

Other golfing aids have attempted to correct the driving or putting angles of a player. U.S. Pat. No. 4,204,332, for example, discloses an aid which is attached to the shaft of a golf club, and which has a movable indicating scale for providing an indication of the amount of angle to be corrected in one's swing. More pertinent to the present invention are U.S. Pat. Nos. 3,680,860 and 3,826,495, which are directed to a method of correcting one's putting stroke by determining the normal angular error introduced into one's stroke, and then marking the player's putter accordingly. The problem with these patents, however, is that they do not utilize or provide a satisfactory device for detecting the degree to which one's putting stroke is in error, such as for example because of a visual impairment, or the like.

Accordingly, a primary object of this invention is to provide a novel device for detecting and correcting a golfer's tendency to misalign a putter face when lining up a putt, a fault which often remains undetected by simple observation of a putting stroke.

Still another object of this invention is to provide a rather simple and inexpensive device of the type described which can be utilized quickly and accurately to determine and correct any putting stroke error which can be traced to misalignment of the putter head.

Other objects of this invention will be apparent hereinafter from the specification and from the recital of the appended claims, particularly when read in conjunction with the accompanying drawing.

SUMMARY OF THE INVENTION

This device comprises a small, horizontally disposed putter aligning plate, which is supported on an underlying base plate for limited angular movement about a vertical axis. Projecting upwardly from the face of the putter aligning late is a putter embracing bracket having formed thereon a pair of spaced, putter-face engaging surfaces which lie in a vertical plane containing the vertical axis about which the putter aligning plate pivots. Two, spaced, manually operable clamps are also mounted on the face of the putter aligning plate for releasably securing the head of a putter on the plate with its face engaging the putter-face engaging surfaces.

In use, the device is positioned on the ground some distance (for example ten or twelve feet) from a circle or hole in the ground representing the cup in a putting green. At the outset the putter aligning plate is held by a manually operable locking screw in a so-called zero position in which the mid point of a series of angular graduations on the edge of the putter aligning plate is aligned with a zero or centering mark inscribed on the edge of the base plate. In this zero position an imaginary line extends horizontally from the center of the hole, through the center of the vertical axis about which the putter aligning plate pivots, and through the center of the graduations on the putter aligning plate.

After a putter head has been clamped on the putter aligning plate, the plate locking screw is released so that the putter aligning plate is free to pivot within limits about its vertical axis. The golfer then grasps the handle of the putter and rotates the putter as he or she believes necessary in order visually to align the face of the putter with the center of the hole. This may cause the putter aligning plate to be rotated slightly from its zero position either clockwise or counterclockwise; and after the golfer has positioned the putter to his or her satisfaction, the degree of offset from the zero or starting point can be determined simply by reading the spaced graduations on the edge of the putter aligning plate against the zero or starting mark located on the edge of the underlying base plate. Then, to correct this improper angle of displacement, the golfer may have inscribed on his or her putter head a special sight line inclined to the one normally inscribed on the putter head.

THE DRAWING

DETAILED DESCRIPTION OF THE PREFERRED EMBODIMENTS

Figure 1:
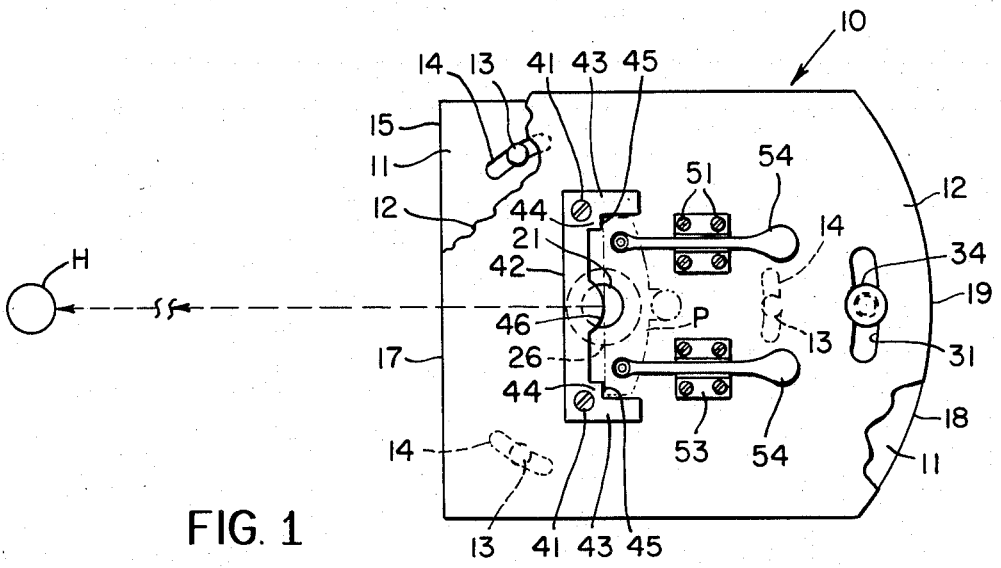
FIG. 1 is a plan view of a putter face aligning device made according to one embodiment of this invention, portions of the device being cut away, and illustrating diagramatically one manner in which the device is disposed to be positioned with the forward end thereof facing the replica of a putting green hole.
Figure 2:
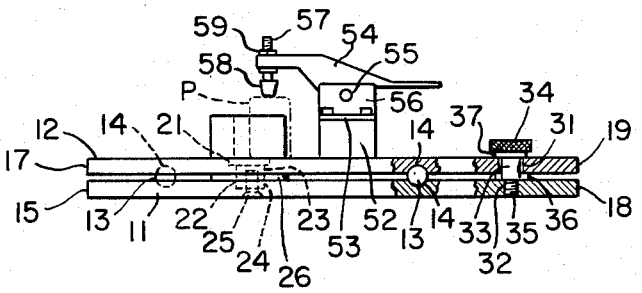
FIG. 2 is a side elevational view of this device, portions of the device again being broken away and shown in section.

Referring now to the drawing by numerals of reference, 10 denotes generally a putter face aligning device comprising a flat, metal base plate 11, and a similarly shaped putter aligning plate 12 which is supported on the face of plate 11 in spaced, parallel relation thereto by a plurality of ball bearings 13 (three in the embodiment illustrated), and for limited pivotal movement relative to the plate 11 about a vertical axis. The ball bearings 13 roll in three pairs of registering, arcuate recesses 14, which are formed in the confronting faces of plates 11 and 12, respectively. Plate 11 has a plane, transversely extending forward edge 15, which registers with a similarly shaped forward edge 17 on plate 12. The rear edge 18 of plate 11, however, is rounded, and registers with a similarly shaped, rounded rear edge 19 that is formed on plate 12.

Plate 12 is removably and rotatably secured to plate 11 by a pivot pin 21, which has a reduced-diameter shank portion 22 that extends slidably and coaxially downwardly through a circular opening 23 that is formed in plate 12 medially of its opposed side edges. The lower end of the shank portion 22 of pin 21 is secured in a counterbore 24 in the face of plate 11 by a screw 25, which threads through the bottom of plate 11 into the lower end of pin 21 coaxially thereof. A large washer 26 surrounds the shank 22 of the pin 21 between the confronting surfaces of plates 11 and 12 to help maintain the plates in spaced, parallel relation.

Adjacent its rear edge 19 plate 12 has therein an elongate, arcuate slot 31, which registers with an internally threaded opening 32 formed through the plate 11. The rotation of plate 12 relative to plate 11 is controlled by a locking screw 33 having an enlarged-diameter, externally knurled head 34 overlying the slot 31, and an externally threaded, reduced-diameter lower end 35, which is adjustably threaded into opening 32 in plate 11. Intermediate its ends screw 33 extends slidably through the slot 31, and a pair of washers 36 and 37, the former of which is interposed between the plates 11 and 12, and the latter of which is interposed between the plate 12 and the head 34 of screw 33.

It will be readily apparent to one skilled in the art that by rotatably adjusting the screw 33, the plate 12 can be secured against rotation relative to plate 11, or alternatively, can be permitted to swing relative to plate 11 to the extent permitted by the overall angular length of slot 31. It will likewise be apparent that the centerlines of slot 31 and the grooves or bearing races 14 are disposed coaxially of the axis of pivot pin 21.

Secured by screws 41 to the face of plate 12 is a generally U-shaped metal bracket 42, which has a plane, vertically disposed forward face, and a pair of spaced, parallel, rearwardly projecting leg sections 43. Adjacent their inner ends the confronting surfaces of the bracket leg sections 43 have formed thereon right-angular projections 44 which form on the rear surface of the bracket a pair of spaced, vertically disposed, coplanar putter face engaging surfaces 45. Surfaces 45 lie in a plane which is coincident with the axis of pin 21, and which registers tangentially with an arcuate projection 46 that is formed on the rear surface of bracket 43 medially of its leg sections 43. (It should be noted that the rounded projection 46 is not necessary for the purposes of this invention, and is included simply to replicate the rounded surface of a golf ball as it would appear were it to be properly located medially of the putting surface of a putter, as noted hereinafter.)

Secured by a plurality of screws 51 to the upper ends of a pair of rectangularly shaped pedestals or spacer blocks 52, which are mounted on plate 12 rearwardly of the bracket 42, are the base plates 53 for a pair of pivotal clamping arms 54. Each arm 54 is mounted intermediate its ends to pivot on a pin 55 carried between a pair of spaced wings 56 on base plate 53. Each pivotal clamping arm 54 has adjustably mounted on its forward end an externally threaded screw 57, the lower end of which has thereon a rubber clamping head 58, which is engagable with the upper end of the head of a putter, as noted hereinafter. A nut 59 which threads onto the upper end of screw 57 is engagable with the associated arm 54 to lock the screw 57 in an adjusted position in the arm.

Figure 3:
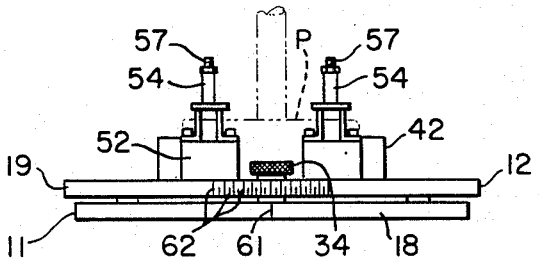
FIG. 3 is an end elevational view of this device as seen when looking at the right end or rear end of the device as shown in FIG. 1.

In use, the device 10 is positioned on a horizontal surface in spaced relation to a circle or hole H (FIG. 1), which is intended to represent the hole in a golf course green. At this time the screw 33 is in its locking position, and a reference mark 61, which is inscribed at the midpoint of the rear edge 18 of plate 11, registers with the midpoint of a plurality of equally spaced graduations 62 (FIG. 3) which are inscribed or otherwise formed on the rounded, rear edge 19 of plate 12 selectively to register with the mark 61. Under these circumstances the centerline of the circle or hole H should lie in a vertical plane which extends normal to surfaces 45, and which contains the centerline of pivot pin 21, and the reference mark 61 on edge 18 of plate 11.

The arms 54 are then swung to their open or extreme clockwise positions (not illustrated) about the pins 55 in order to permit the head P of a putter (shown in phantom by broken lines in the drawing) to be placed between the leg sections 43 of bracket 42, and with the plane putting surface of the putter head positioned in coplanar engagement with the putter face engaging surfaces 45 of the bracket. The clamp arms 54 are then swung back into the clamping positions shown in the drawing in order to clamp the putter head P in place. Screw 22 is then backed off so that plate 12 is now free to rotate relative to plate 11; and the golfer grasps the handle associated with the putter head P, and peering in the direction indicated by the broken line and arrows in FIG. 1, rotates or twists the putter head until its face, at least as far as that particular golfer is concerned, registers properly with the center of the hole H. Screw 33 is then once again secured to lock the plate 12 against further rotation relative to plate 11, and the difference, if any, between the original position of plate 12 relative to plate 11 can be determined by comparing the reference line 61 on plate 11 with the graduations 62 on plate 12.

Figure 4:
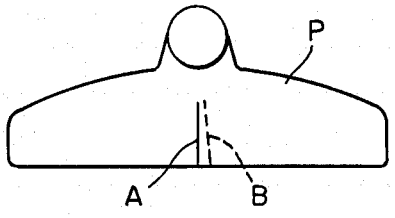
FIG. 4 is an enlarged, fragmentary plan view of a conventional putter showing standard and modified sight lines thereon, respectively.

In practice the space between adjacent graduations 62 may represent, for example, one half of one degree, so that by observing these graduations, the operator can determine the amount or the degree to which the golfer has misaligned the putter face. When this offset has been determined, it is then possible to correct or offset this misalignment by inscribing on the head of the putter, adjacent to the normal putter centerline A (FIG. 4), a new centerline (B in FIG. 4) which should be used by the golfer for alignment with a putting green hole in order to compensate for any misalignment he or she normally would tend to introduce into his or her putting stroke.

From the foregoing it will apparent that the present invention provides relatively simple and inexpensive means for detecting the amount of misalignment of the putting face which a golfer might tend to introduce to his or her putting stroke each time a golf ball is so addressed. By determining this natural tendency to misalign the face of the putter, and then marking a new line on the head of the putter to denote the centerline which should be employed by that particular golfer, it is possible substantially to reduce errors in one's putting stroke.

While this invention has been illustrated and described in connection with a certain clamping mechanism which is employed for locking the putter head in place against the bracket 42, it will be apparent to one skilled in the art that other types of conventional clamping devices could be employed, if desired. Moreover, instead of the two, spaced, putter face engaging surfaces 45 on bracket 42, one, continuous such surface could be employed for engagement with the face of the putter head. Also, of course, the plates 11 and 12 need not necessarily be made from metal; nor do the mark 61 and graduations 62 need be placed at any particular location on plates 11 and 12, provided they will function to indicate the proper zero or starting position of plate 12 relative to plate 11, and any angular displacement from such position.

Furthermore, while this invention has been illustrated and described in detail in connection with only certain embodiments thereof, it will be apparent that this application is intended to cover any such modifications as may fall within the scope of one skilled in the art, or the appended claims.

I claim:

1. A device for detecting alignment errors in a golfer's putting stroke, comprising a first member disposed to be placed in an operative position on a generally horizontal surface, and in spaced relation to a circular putting hole represented on said surface, a second member mounted on said first member for limited rotational movement relative to said first member about a generally vertical axis, one of said members having thereon a reference mark disposed selectively to register with one of a plurality of equi-spaced graduations on the other of said members, when said second member is rotated relative to said first member, means for releasably locking said second member against rotation on said first member, and selectively in a starting position in which said reference mark registers with the midpoint of said spaced graduations, means on said second member defining a first, generally vertical plane disposed to extend at right angles to a line connecting said vertical axis and the center of said hole, and to represent proper putter face alignment, when said second member is in said starting position and said first member is placed in its operative position on said horizontal surface, and means for releasably securing a putter head to said second member with the face of said putter head disposed in said first vertical plane.

2. A device as defined in claim 1, wherein said spaced graduations are calibrated in degrees of rotation of said second member relative to said first member, whereby when said locking means is released and a golfer manipulates the handle of said putter to align its face with said hole, the degree of rotation of the putter face from proper alignment with said hole can be determined by reading said reference mark against said graduations.

3. A device as defined in claim 1,.wherein said first vertical plane is coincident with said vertical axis.

4. A device as defined in claim 3, wherein, when said second member is in said starting position, said vertical axis, said reference mark and said midpoint of said graduations lie in a second plane which extends normal to said first plane.

5. A device as defined in claim 1, wherein said reference mark is on said first member and said graduations are on said second member.

6. A device as defined in claim 1, wherein said first member comprises a first, generally flat plate, said second member comprises a second, generally flat plate mounted for limited rotational movement on said first plate about said vertical axis, and having thereon a curved edge registering vertically and coaxially with a curved edge on said first plate, and said reference mark is positioned on one of said curved edges medially thereof, and said spaced graduations are positioned on the other of said curved edges selectively to register with said reference mark.

7. A device as defined in claim 1, wherein said first and second members comprise a pair of generally flat plates one of which is mounted for limited rotation on the other about said vertical axis, said means defining said first vertical plane comprises a plane, putter engaging surface projecting vertically upwardly from the upper surface of said one plate, when said other plate is placed in said operative position on said horizontal surface, and said means for releasably securing said putter head comprises at least one manually operable clamp mounted on said one plate adjacent said putter engaging surface and operable releasably to clamp the head of a putter on said one member with the face of the putter disposed in coplanar engagement with said putter engaging surface

8. A device as defined in claim 1, wherein said second member has thereon a substantially plane upper surface, said means defining said first vertical plane comprises a putter engaging member secured on said upper surface of said second member and having formed thereon a pair of spaced, coplanar surfaces which lie in said first vertical plane, and said putter head securing means comprises at least one clamping mechanism mounted on said second member and operable to engage and hold the head of a putter on the upper surface of said second member with the handle of the putter extending upright, and with the face of the putter head engaged in coplanar relation with said spaced, coplanar surfaces on said putter engaging member.

* * * * *